United States Patent [19]

Fantuzzo

[11] 4,320,958

[45] Mar. 23, 1982

[54] COMBINED PROCESSING UNIT

[75] Inventor: Joseph Fantuzzo, Webster, N.Y.

[73] Assignee: Xerox Corporation, Stamford, Conn.

[21] Appl. No.: 200,681

[22] Filed: Oct. 27, 1980

[51] Int. Cl.[3] ..... G03G 15/00

[52] U.S. Cl. ..... 355/3 DD; 118/652; 118/658; 355/15

[58] Field of Search ..... 355/3 DD, 15; 118/652, 118/657, 658; 430/125; 15/256.52

[56] References Cited

U.S. PATENT DOCUMENTS

| | | | |
|---|---|---|---|
| 3,637,306 | 1/1972 | Cooper | 355/15 |
| 3,647,293 | 3/1972 | Queener | 355/15 |
| 3,838,921 | 10/1974 | Sargis | 355/15 |
| 4,003,651 | 1/1977 | Hashida | 355/15 X |
| 4,084,542 | 4/1978 | Okada et al. | 118/658 |
| 4,087,170 | 5/1978 | Sawaoka et al. | 355/15 X |
| 4,142,165 | 2/1979 | Miyakawa et al. | 118/657 X |
| 4,174,903 | 11/1979 | Snelling | 355/3 DD |
| 4,185,910 | 1/1980 | Nomura et al. | 118/652 X |
| 4,205,912 | 6/1980 | Yamaguchi | 118/652 X |
| 4,279,942 | 7/1981 | Swapceinski | 118/658 X |

*Primary Examiner*—Richard L. Moses
*Attorney, Agent, or Firm*—H. Fleischer; H. M. Brownrout

[57] ABSTRACT

An electrophotographic printing machine in which a single processing station performs the functions of cleaning a photoconductive member and developing an image recorded thereon. The magnetic field, in the region of the photoconductive member, is controlled so as to be weak during development and strong during cleaning.

14 Claims, 5 Drawing Figures

COMBINED PROCESSING UNIT

This invention relates generally to an electrophotographic printing machine, and more particularly concerns an improved processing station which performs the dual functions of cleaning and developing.

In an electrophotographic printing process, a photoconductive member has the surface thereof charged to a substantially uniform level. The charged photoconductive member is exposed to a light image of the original document being reproduced. Exposure of the sensitized photoconductive surface selectively discharges the charge thereon. This records an electrostatic latent image on the photoconductive surface corresponding to the informational areas contained within the original document being reproduced. Development of the electrostatic latent image recorded on the photoconductive surface is achieved by bringing developer material into contact therewith. Typical developer materials employ toner particles and carrier granules. Generally, the toner particles are made from heat settable thermal plastic particles, while the carrier granules are made from coarser ferromagnetic granules. Alternatively, the developer material may comprise a single component, such as fine conductive magnetic particles. In either case, when the developer material is brought into contact with the latent image recorded on the photoconductive surface, a greater attractive force thereof causes particles to adhere to the electrostatic latent image. This forms a powder image on the photoconductive member which is subsequently transferred to a copy sheet. Finally, the copy sheet is heated to permanently affix the powder image thereto to image configuration.

Hereinbefore, each of the foregoing steps were gradually performed at individual processing stations. For example, the charging step was performed at a charging station, exposure at an imaging station, development at a development station, transfer at a transfer station, and cleaning at a cleaning station. Each of the processing stations were generally separate and independent from one another.

Various types of devices have hereinbefore been devised to combine the various steps in single processing stations. The following disclosures appear to be relevant:

U.S. Pat. No. 3,637,306
Patentee: Cooper
Issued: Jan. 25, 1972
U.S. Pat. No. 3,647,293
Patentee: Queener
Issued: Mar. 7, 1972
U.S. Pat. No. 3,838,921
Patentee: Sargis
Issued: Oct. 1, 1974
U.S. Pat. No. 4,087,170
Patentee: Sawaoka et al.
Issued: May 2, 1978
U.S. Pat. No. 4,174,903
Patentee: Snelling
Issued: Nov. 20, 1979

The pertinent portions of the foregoing disclosures may be briefly summarized as follows:

Cooper discloses an electrophotographic printing machine employing a developing-cleaning unit which performs either function at the proper time during the copying sequence. A magnetic brush unit serves both as the developer and cleaner in the system.

Queener describes a developing-cleaning unit having a magnetic brush unit which serves both functions. In the developing mode, toner particles are attracted from the carrier granule of the unit to the photoconductive layer. When used in the cleaning mode, the developer brushes against the photoconductive layer to scavenge residual toner particles remaining thereon.

Sargis describes a magnetic brush for developing an electrostatic latent image recorded on a photoconductive surface during one cycle and removing particles therefrom during the next cycle.

Sawaoka et al. discloses a development-cleaning combination unit including a magnetic roller for developing the latent image during one drum rotation and removing particles from the drum during the next rotation thereof.

Snelling describes a combined unit which develops an electrostatic latent image and cleans the photoconductive surface. The unit includes a rotating tubular member having a magnet disposed interiorly thereof. An appropriate electrical bias is applied to the tubular member to achieve either development or cleaning.

In accordance with the present invention, there is provided an apparatus for cleaning particles from a surface in one mode of operation and depositing particles thereon in another mode of operation. The apparatus includes means for transporting particles from the surface during the cleaning mode of operation and to the surface during the depositing mode of operation. Means are provided for producing a magnetic field extending about the transporting means. Means control the producing means so that the strength of the magnetic field about the transporting means in the region of the surface is weak during the depositing mode of operation and strong during the cleaning mode of operation.

Other aspects of the present invention will become apparent as the following description proceeds and upon reference to the drawings, in which.

While the present invention will hereinafter be described in connection with a preferred embodiment thereof, it will be understood that it is not intended to limit the invention to this embodiment. On the contrary, it is intended to cover all alternatives, modifications and equivalents as may be included within the spirit and scope of the invention as defined by the appended claims.

Figure 1:
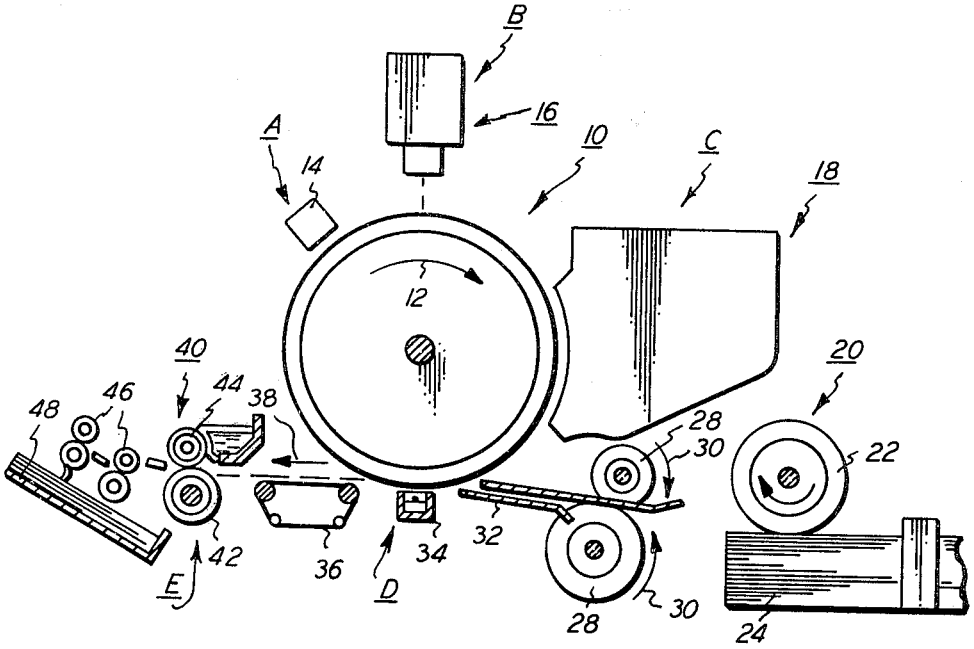
FIG. 1 is a schematic elevational view depicting an electrophotographic printing machine incorporating the features of the present invention therein.

For a general understanding of the features of the present invention, reference is made to the drawings. In the drawings, like reference numerals have been used throughout to designate identical elements. FIG. 1 schematically depicts the various components of an illustrative electrophotographic printing machine incorporating the combined cleaning and developing system of the present invention therein. It will become evident from the following discussion that the combined cleaning and developing processing station described hereinafter is equally well suited for use in a wide variety of electrostatographic printing machines and is not necessarily limited in its application to the particular embodiment shown therein.

Inasmuch as the art of electrophotographic printing is well known, the various processing stations employed in the FIG. 1 printing machine will be shown hereinafter schematically and their operation described briefly with reference thereto.

As shown in FIG. 1, the electrophotographic printing machine employs a drum, indicated generally by the reference numeral 10. Preferably, drum 10 includes a conductive substrate, such as aluminum having a photoconductive material, e.g. a selenium alloy, deposited thereon. Drum 10 rotates in the direction of arrow 12 to pass through the various processing stations disposed thereabout.

Initially, drum 10 moves a portion of the photoconductive surface through charging station A. At charging station A, a corona generating device, indicated generally by the reference numeral 14, charges the photoconductive surface of drum 10 to a relatively high, substantially uniform potential.

Thereafter, the charged portion of the photoconductive surface of drum 10 is advanced through imaging station B. At imaging station B, an original document is positioned facedown upon a transparent platen. The imaging system, indicated generally by the reference numeral 16, includes a lamp which moves across the original document illuminating incremental widths thereof. The light rays reflected from the original document are transmitted through a moving lens system to form incremental width light images. These light images are focused by the lens onto the charged portion of the photoconductive surface. In this manner, the charged photoconductive surface of drum 10 is discharged selectively by the light image of the original document. This records an electrostatic latent image on the photoconductive surface which corresponds to the informational areas contained within the original document.

Next, drum 10 advances the electrostatic latent image recorded on the photoconductive surface to combined cleaning-developing station C. At combined station C, a magnetic brush system, indicated generally by the reference numeral 18, transports developer material into contact with the photoconductive surface of drum 10 during the developing cycle. The toner particles of the developer material are attracted to the electrostatic latent image forming a toner powder image corresponding to the informational areas of the original document.

After the toner powder image is deposited on the photoconductive surface, drum 10 advances the toner powder image to transfer station D. At transfer station D, a sheet of support material is positioned in contact with the powder image formed on the photoconductive surface of drum 10. A sheet of support material is advanced to transfer station D by a sheet feeding apparatus, indicated generally by the reference numeral 20. Preferably, sheet feeding apparatus 20 includes a feed roll 22 contacting the uppermost sheet of the stack 24 of sheets of support material. Feed roll 22 rotates in the direction of arrow 26 so as to advance the uppermost sheet from stack 24. Registration rollers 28, rotating in the direction of arrow 30, align and forward the advancing sheet of support material into chute 32. Chute 32 directs the advancing sheet of support material into contact with the photoconductive surface of drum 10 in a timed sequence. This insures that the toner powder image contacts the advancing sheet of support material at transfer station D.

Transfer station D includes a corona generating device 34, which applies a spray of ions to the backside of the sheet. This attracts the powder image from the photoconductive surface of drum 10 to the sheet. After transfer, the sheet continues to move with drum 10. A detack corona generating device (not shown) neutralizes the charge causing the sheet to adhere to the drum. The sheet is then separated from drum 10. Conveyor 36 advances the sheet in the direction of arrow 38, from transfer station D to fusing station E. Fusing station E, indicated generally by the reference numeral 40, includes a back-up roller 42 and a heated fuser roller 44. The sheet of support material, with the powder image thereon, passes between back-up roller 42 and fuser roller 44. The powder image contacts fuser roller 44 and the heat and pressure applied thereto firmly affixes it to the sheet of support material. After fusing, forwarding rollers 46 advance the finished copy sheet to catch tray 48. Once a copy sheet is positioned in catch tray 48, it may be readily removed therefrom by the machine operator.

Invariably, after the sheet of support material is separated from the photoconductive surface of drum 10, some residual particles remain adhering thereto. These residual particles are cleaned from drum 10 at combined processing station C. In this latter cleaning mode of operation, corona generating device 14, at charging station A, and exposure system 16, at imaging station B, are de-energized. Thus, the particles adhering to the photoconductive surface of drum 10 are advanced during this second cycle through processing station C which is now in the cleaning mode of operation. In the cleaning mode of operation, the magnetic field between the photoconductive surface and transport roller is maintained at a high value. During the developing mode of operation, the magnetic field strength is maintained at a low level. The detailed structure of combined processing station 18 will be described hereinafter with reference to FIGS. 2 through 5, inclusive.

It is believed that the foregoing description is sufficient for purposes of the present application to illustrate the general operation of the illustrative electrophotographic printing machine incorporating the combined processing station therein.

Figure 2:
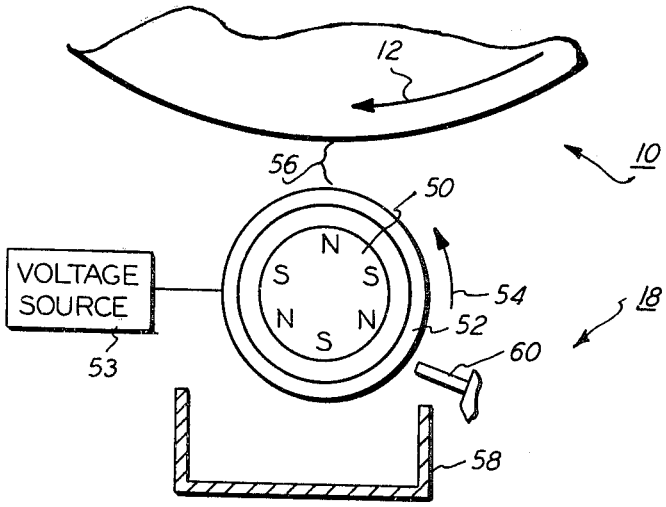
FIG. 2 is a schematic elevational view showing the processing station of the present invention in the cleaning mode of operation.

Referring now to the specific subject matter of the present invention, FIG. 2 depicts combined processing station 18 in the cleaning mode of operation. As depicted thereat, a cylindrical magnet 50 having a plurality of magnetic poles present about the circumferential surface thereof is disposed interiorly of a non-magnetic conductive, tubular member 52. The interior circumferential surface of tube 52 is based from the exterior circumferential surface of magnetic 50. Tube 52 is mounted rotatably and coupled to a drive motor. Magnet 50 is coupled to an indexing motor. Preferably, magnet 50 is made from barium ferrite with tube 52 being made from aluminum. Tube 52 rotates in the direction of arrow 54. Tube 52 is positioned closely adjacent to the photoconductive surface of drum 10. The gap 56 between the exterior circumferential surface of tube 52 and the photoconductive surface depicts both the cleaning zone and the development zone. The indexing motor is controlled to rotate magnet 50 so as to position a pole opposed from the photoconductive surface in the region of gap 56. In this way, there is a strong magnetic field during the cleaning mode of operation. This strong magnetic force field creates a stiff brush of material which enhances cleaning. Voltage source 58 is connected to tube 52 and applies an electrical biasing field thereto. The electrical voltage applied to tube 52 ranges from about 50 volts to about 500 volts. The exact value of the voltage is dependent upon the level of background recorded on the photoconductive surface and the voltage level of the electrostatic latent image. Preferably, tube 52 is electrically biased to a voltage level exceeding that of the latent image during the cleaning mode of operation. Housing 60 stores a supply of developer material. The developer material is attracted to the surface of tube 52. The developer material comprises magnetic carrier granules having toner particles adhering triboelectically thereto. As tube 52 rotates in the direction of arrow 54, the strong magnetic field in conjunction with the electrical biasing applied thereto attracts residual toner particles adhering to the surface of drum 10. A metering blade 60 is positioned closely adjacent to tube 52 and shears the extraneous particles therefrom. Under the influence of gravity, the extraneous particles deflected or sheared from tube 52 by metering blade 60 fall into the chamber of housing 58.

Figure 3:
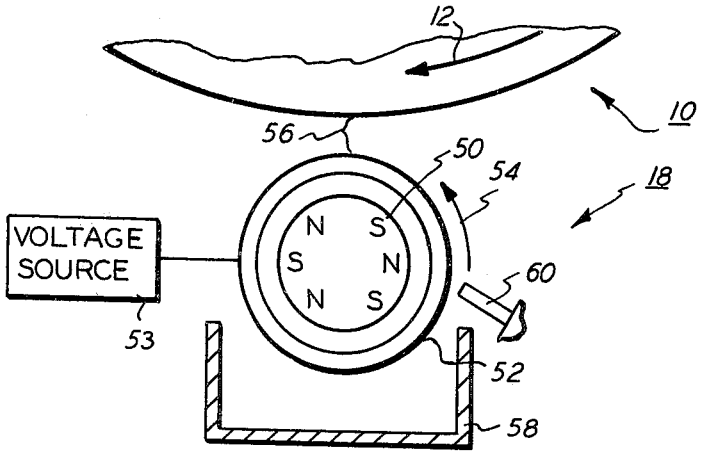
FIG. 3 is a schematic elevational view illustrating the processing station of the present invention in the developing mode of operation.

Turning now to FIG. 3, there is shown combined processing station 18 in the development mode of operation. As illustrated thereat, magnetic member 50 is indexed so as to have no magnetic poles opposed from photoconductive surface 12 in the region of gap 56. In this way, a weak magnetic field is formed in gap 56. The weak magnetic field creates a soft brush of material which enhances development. In operation, voltage source 53 electrically biases tubular member to a voltage level intermediate that of the background voltage and latent image voltage recorded on photoconductive surface 12. As tubular member 52 rotates in the direction of arrow 54, developer material is transported into gap 56 and positioned in contact with photoconductive surface 12. The electrostatic latent image recorded thereon attracts the toner particles from the carrier granules forming the toner powder image. Metering blades 60 shears the extraneous developer material from the circumferential surface of tube 56.

It is thus clear that combined processing unit 18 both transports particles to the photoconductive surface and removes particles therefrom. During the cleaning or removing mode of operation, the magnetic member is controlled to produce a strong magnetic field in the gap between the exterior circumferential surface of the rotating tubular member and the photoconductive surface. During the development mode of operation, the magnetic member is controlled so as to produce a weak magnetic field in the gap between the photoconductive surface and the exterior circumferential surface of the tubular member. In this way, both development and cleaning are optimized in terms of the strength of the magnetic field during the respective operation.

Figure 4:
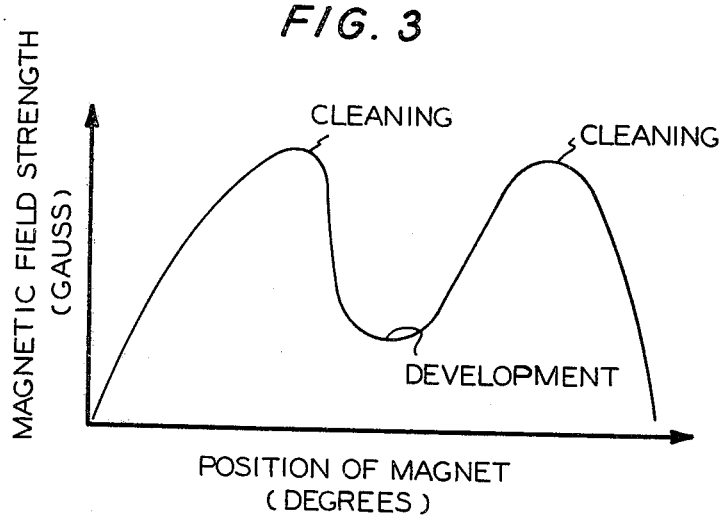
FIG. 4 is a graph depicting the magnetic field strength for the processing station in the FIG. 2 cleaning mode of operation and in the FIG. 3 developing mode of operation.

Referring now to FIG. 4, there is shown a graph of the strength of the magnetic field of magnetic member 50 as a function of the angular rotation thereof relative to gap 56. During the cleaning operation, the magnetic field is strong, as depicted by the high magnetic field strength. This is achieved by positioning a pole opposed from the photoconductive surface in the region of gap 56. During the development mode of operation, the magnetic field strength is low. This is accomplished by indexing the magnetic member 50 so as to position no poles in the region of gap 56.

Figure 5:
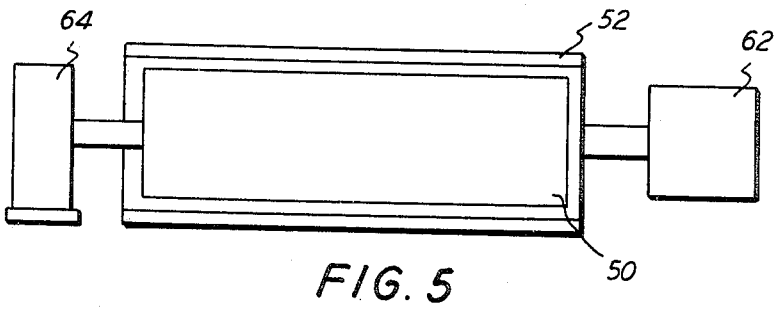
FIG. 5 is a schematic elevational view illustrating the drives used for the processing station.

Referring now to FIG. 5, the drive system for both magnetic member 50 and tubular member 52 are depicted thereat. As shown, a constant speed motor 62 is coupled directly to tubular member 52 which is mounted on suitable bearings for rotation. Motor 62 rotates tubular member 52 at a substantially constant angular velocity. Magnetic member 50 is also mounted on suitable bearings and coupled to indexing motor 64. Indexing motor 64 is arranged to rotate magnetic member 50 through an acute angle between the cleaning mode of operation and the developing mode of operation. This acute angle ranges from about 10° to about 20° and depends upon the spacing between adjacent magnetic poles. Thus, during the cleaning mode of operation, indexing motor 64 rotates magnetic member 50 so as position a magnetic pole opposed from the photoconductive surface in the region of the gap between tubular member 52 and the photoconductive surface. During the development mode of operation, indexing motor 64 rotates tubular member 50 one half the angular spacing between adjacent poles so as to position no magnetic pole in the region of the gap between tubular member 52 and the photoconductive surface. In this way, the magnetic field is controlled so as to optimize both development and cleaning by having a strong magnetic field produced during cleaning and a weak magnetic field produced during development.

One skilled in the art will appreciate that there are many other ways of regulating the magnetic field in the gap between tubular member 52 and the photoconductive surface. For example, if an electromagnet is employed, the current exciting the electromagnet may be regulated so as to produce a strong magnetic field during cleaning and a weak magnetic field during development. It is apparent that there is not always a necessity to rotate the magnet to affectuate control of the strength of the magnetic field in the gap.

In recapitulation, it is clear that the combined processing station of the present invention both develops the electrostatic latent image recorded on the photoconductive surface and removes extraneous particles remaining thereon. The cleaning and developing modes of operation are each optimized by controlling the strength of the magnetic field during the respective operation. Thus, during the cleaning mode of operation the magnetic field is controlled to be relatively strong in the gap between the tubular member and the photoconductive surface. However, during the development mode of operation, the strength of the magnetic field is maintained relatively weak in the gap between the photoconductive surface and the tubular member. In this manner, the combined processing station substantially optimizes the processing steps of cleaning and developing.

It is, therefore, evident that there has been provided in accordance with the present invention, an apparatus for cleaning a photoconductive surface and developing an electrostatic latent image recorded thereon. This apparatus fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. An apparatus for cleaning particles from a surface in one mode of operation and depositing particles thereon in another mode of operation, including:

means for transporting particles from the surface during the cleaning mode of operation and to the surface during the depositing mode of operation;

means for producing a magnetic field extending about said transporting means; and means for controlling said producing means so that the strength of the magnetic field about said transporting means in the region of the surface is weak during the depositing mode of operation and strong during the cleaning mode of operation.

2. An apparatus according to claim 1, wherein said transporting means includes:

a non-magnetic tubular member spaced from the surface to define a gap therebetween; and means for rotating said tubular member.

3. An apparatus according to claim 2, wherein said producing means includes an elongated magnetic member disposed interiorly of said tubular member.

4. An apparatus according to claim 3, wherein said controlling means includes means for indexing said magnetic member to position the region of said magnetic member having the strong magnetic field opposed from the gap during the cleaning mode of operation and the region of the weak magnetic opposed from the gap during the depositing mode of operation.

5. An apparatus according to claims 2 and 4, further including means for electrically biasing said tubular member.

6. An apparatus according to claim 4, wherein said indexing means rotates said magnetic member through an acute angle when changing modes of operation.

7. An apparatus according to claim 6, wherein said indexing means rotates about magnetic member preferably through an angle ranging from about 10° to about 20°.

8. An electrophotographic printing machine of the type having a combined developing-cleaning unit for developing an electrostatic latent image recorded on a photoconductive surface in one mode of operation and cleaning particles from the photoconductive surface in another mode of operation, wherein the improvement includes:

means for removing particles from the photoconductive surface during the cleaning mode of operation and depositing particles on the electrostatic latent image recorded on the photoconductive surface during the developing mode of operation;

means for producing a magnetic field extending about said removing and depositing means; and means for controlling said producing means so that the strength of the magnetic field about said removing and depositing means in the region of the photoconductive surface is weak during the depositing mode of operation and strong during the cleaning mode of operation.

9. A printing machine according to claim 8, wherein said removing and depositing means includes:

a non-magnetic tubular member spaced from the photoconductive surface to define a gap therebetween; and means for rotating said tubular member.

10. A printing machine according to claim 9, wherein said producing means includes an elongated magnetic member disposed interiorly of said tubular member.

11. A printing machine according to claim 10, wherein said controlling means includes means for indexing said magnetic member to position the region of said magnetic member having the strong magnetic field opposed from the gap during the cleaning mode of operation and the region of the weak magnetic field opposed from the gap during the depositing mode of operation.

12. A printing machine according to claims 8 and 11, further including means for electrically biasing said tubular member.

13. A printing machine according to claim 10, wherein said indexing means rotates said magnetic member through an acute angle when changing modes of operation.

14. A printing machine according to claim 13, wherein said indexing means rotates said magnetic member through an angle preferably ranging from about 10° to about 20°.

* * * * *